United States Patent [19]

Leone

[11] Patent Number: 5,073,062

[45] Date of Patent: Dec. 17, 1991

[54] APPARATUS FOR TEXTURING BRIDGE DECKS, RUNWAYS AND THE LIKE

[76] Inventor: John Leone, 999 Aero Dr., Cheektowaga, N.Y. 14221

[21] Appl. No.: 200,445

[22] Filed: May 31, 1988

[51] Int. Cl.[5] ..... E01C 23/02

[52] U.S. Cl. ..... 404/75; 404/89; 404/93

[58] Field of Search ..... 404/75, 93, 94, 89, 404/87, 90; 264/293; 425/336, 385

[56] References Cited

U.S. PATENT DOCUMENTS

| | | | |
|---|---|---|---|
| 864,069 | 8/1907 | Blome et al. | 404/93 |
| 1,064,133 | 6/1913 | Dervoz | 404/93 |
| 1,291,544 | 1/1919 | Keenan | 404/93 |
| 3,516,339 | 6/1970 | Perkins | 404/93 X |
| 3,516,340 | 6/1970 | Perkins | 404/75 |
| 3,648,575 | 3/1972 | Rasmussen | 404/87 X |
| 3,683,762 | 8/1972 | Maynard et al. | 404/93 |
| 3,775,018 | 11/1973 | Barton | 404/93 |
| 3,810,709 | 5/1974 | Weaver et al. | 404/93 |
| 4,744,694 | 5/1988 | Leone | 404/89 |

*Primary Examiner*—William P. Neuder
*Attorney, Agent, or Firm*—Bernard A. Chiama

[57] ABSTRACT

A method and apparatus is disclosed for producing grooves in plastic concrete bridge decks, airport runways and the like having a cutter bar supporting a plurality of parallel cutter blades adapted to be imbedded in the surface of a deck. The cutter bar is adapted to be moved transversely across the deck and is mounted for pivotal movement on an axis normal to its transverse movement. The extent of pivotal movement is such as to raise and maintain the leading ends of the cutter blades slightly above the surface of the deck during the transverse movement.

3 Claims, 5 Drawing Sheets

PRIOR ART

APPARATUS FOR TEXTURING BRIDGE DECKS, RUNWAYS AND THE LIKE

The present invention is directed to an apparatus for producing transverse grooves in concrete bridge decks associated with highway surfaces, and to airport runways, or sections thereof. More specifically, the invention is an improvement of the method and apparatus described in U.S. patent application of John Leone, filed on Feb. 2, 1987, Ser. No. 009,730.

As stated in that application, more recent highway bridges, concrete bridge decks, or those one or more large segments of the bridge surfaces which go to make the road surface of the bridge, are Provided with transverse grooves in order to prevent vehicle skidding under icing conditions or during heavy rain. Transverse orientation of grooves is preferred over longitudinal grooves for bridge surfaces because transverse grooves provide better surface gripping action and do not produce the vehicle swaying motion that is generally caused by longitudinal grooves.

Conventional methods of producing transverse grooves on concrete bridge decks and airport runways involve the steps of finishing the concrete applied thereto while in a plastic condition to a uniformly smooth, dense, even surface and texturing the surface in a transverse direction with an artificial turf drag. The finishing movement and resulting progress of the turf drag is performed in such a manner as to prevent ridges and gouges forming in the concrete surface. In the case of a bridge deck, the texturing step is stopped a short distance, generally one foot or so, from the curbing or railing associated with the bridge deck.

After a minimum of 14 days following the initial texturing, or at least until the concrete slab comprising the bridge deck or runway is set, the same is subjected to sawcutting grooves into the surface of the slab. In the current grooving method, the plastic concrete is initially cured after the application of the turf drag and subsequently cured again after the saw cutting/grooving operation.

In addition to the disadvantages of requiring many operative steps to accomplish (one of which, saw cutting/grooving being time consuming with consequent loss of time during which the bridge deck or runway may not be used) is the relatively rapid deterioration of the resultant deck or runway.

Therefore, it is the principal object of the present invention to produce transverse grooving of the bridge decks and airport runways and the like in the shortest possible time and requiring steps and apparatus which are simple and economical to perform and utilize.

It is another object of the invention to produce transverse grooving in bridge decks and runways which will be accurate in form and free of imperfections.

The objects of the invention are accomplished by a method and apparatus which require forming transverse grooves while concrete is in the plastic state. A grooving apparatus is devised which forms the grooves from one side of a concrete bed such as a bridge deck or an airport runway to the other side thereof. The apparatus is provided with one or more cutter bars, each including a plurality of elongated, parallel-arranged cutter blades being spaced from each other by spacers. The cutting edges of the blades are tapered to produce grooves in the plastic concrete having a triangular configuration as the blades are moved in a direction along their longitudinal axes.

The one or more cutter bars are mounted on a carriage arranged for movement transverse to the longitudinal axis of the bridge. Each of the cutter bars is pivotally mounted on the carriage on a pivotal axis normal to the direction of movement of the carriage and means are provided which will upwardly tilt the bar a slight distance before movement thereof so that the leading ends of the cutter blades are above the surface of the plastic concrete. In this manner, the likelihood that the leading edge of the cutter bar and ends of the blades will plow into the concrete is eliminated. The carriage, in turn, is movably mounted on a conventional concrete paving machine which is propelled longitudinally along the concrete bed on rails arranged on the sides thereof.

In operation, the carriage is propelled from one side of the concrete bed to the other while the paving machine is held stationary to produce a first series of grooves. The paving machine is then moved longitudinally a distance equal to the length of the carriage and the carriage is driven back to its initial position to produce a second series of grooves, and the process is repeated in a stop and repeat progression method. Before each transverse movement of the carriage is initiated, the cutter bar is tilted so that the leading edge and adjacent ends of the blades are above the surface of the concrete.

In addition to the art described above, U.S. Pat. No. 3,516,340 discloses a grooving method and apparatus for producing transverse grooves in a road. Molding bars are provided for supporting tapered formed ribs, the ribs being longitudinally spaced so as to produce the transverse grooves. However, the molding bars are held rigid by a plurality of hydraulic or pneumatic cylinders so that the ribs ar lowered into and out of plastic concrete.

In the above referred to U.S. patent application Ser. No. 009,730, for which the present invention is an improvement, a cutter bar is disclosed as having means for allowing its rocking motion so that the same and the cutter blades supported therefrom assume the orientation of the surface of plastic concrete to-be-grooved. While this disclosure is generic to the concept of providing pivoting movement to a cutter bar, there is no disclosure of means for positively insuring that the leading edge of the cutter bar and the adjacent ends of the blades are raised slightly so as to prevent plowing of the concrete by the blades upon engagement thereof with aggregate in the concrete.

Other objects and advantages will become apparent from the following description taken in conjunction with the accompanying drawings wherein:

FIGS. 1 (*a*) and 1(*b*) are schematic, cross sectional views of a portion of a concrete bridge deck showing grooves formed by conventional methods;

Figure 7:
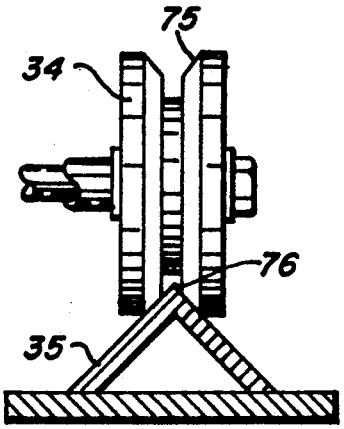
Figure 5A:
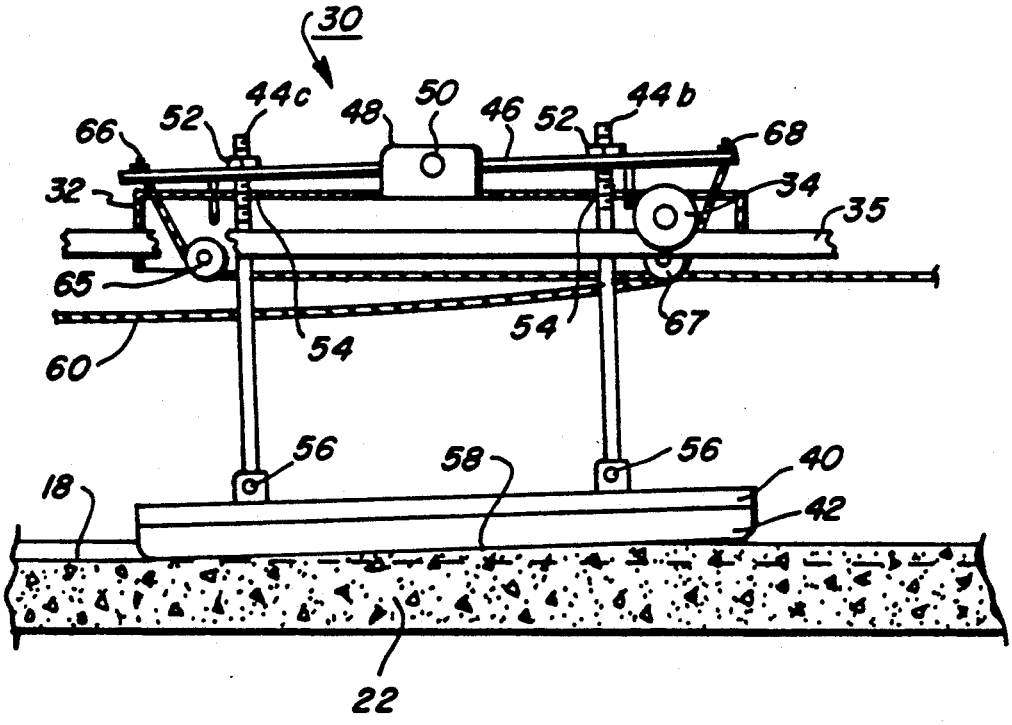
Figure 5B:
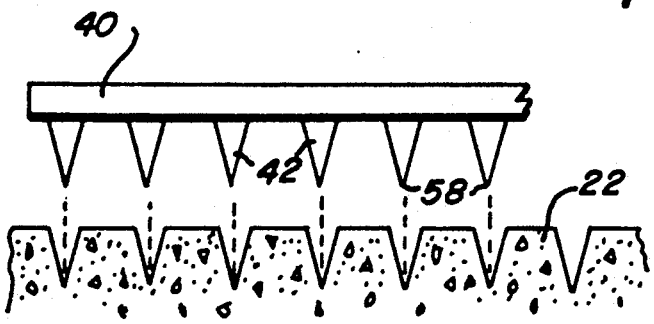
Figure 6:
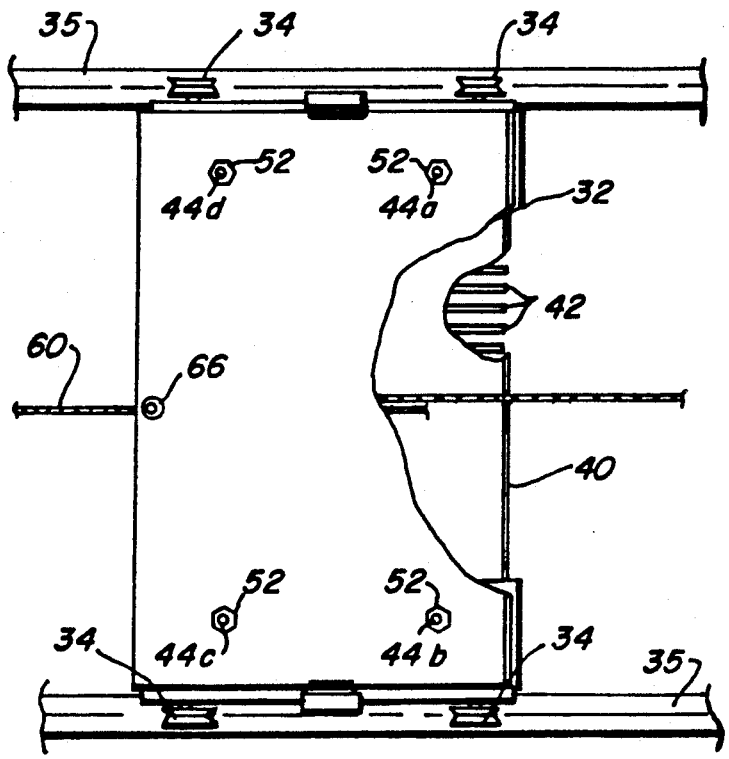

FIG. 5*a* is a schematic view of the carriage and cutter bar of the present invention;

FIG. 5*b* is a partial end view of the cutter bar;

FIG. 6 is an elevational view of the cutter bar;

FIG. 7 is a partial view of a detail; and

Figure 8:
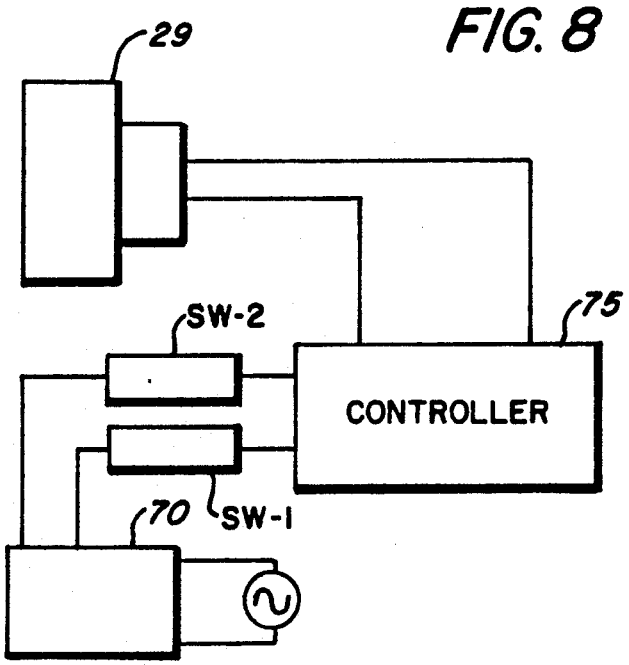

FIG. 8 is a schematic diagram of a control system arranged to provide full automatic control to the present invention.

Figure 1A:
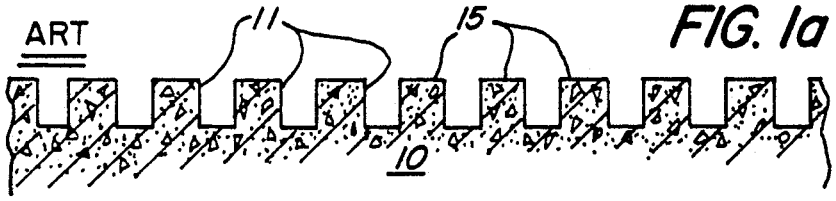
FIG. 1a PRIOR ART
Figure 1B:
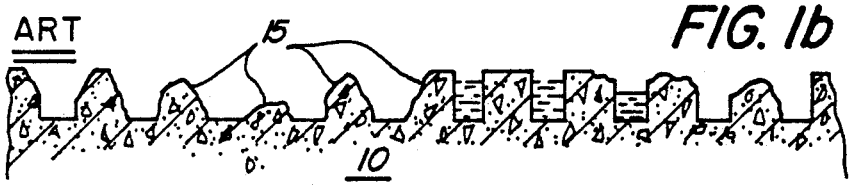

The formation of transverse grooves in a concrete bed such as a bridge deck 10 by the conventional methods results in grooves 11 having rectangular shapes as shown in FIG. 1(*a*). The grooves are cut into the surface of the concrete bed surface by a multitude of rotary cutting blades after concrete is laid and allowed to cure, generally about one to two weeks after pouring.

The rectangular shapes of the grooves 11 result in the high accumulation of water in the grooves during melting of snow or heavy rainfall. Repeated freezing of the accumulated water in the grooves expands to cause deterioration of the concrete ridges 15 between the grooves 11 as shown in FIG. 1(*b*). Such deterioration in time may effect complete or near complete destruction of the ridges in the worst situation, or to produce the rounding of the ridges at the corners thereof. In either situation, the destruction or rounding of the ridges will lessen or eliminate the use of the grooving for preventing vehicle skidding.

Figure 2:
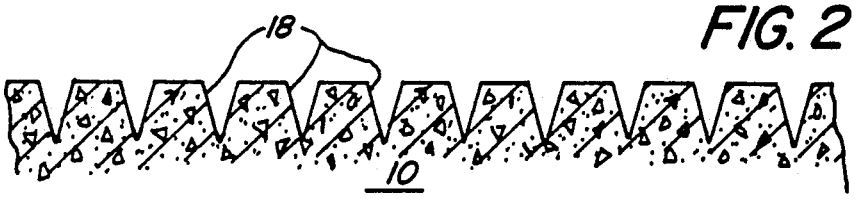
FIG. 2 is a schematic cross-sectional view of a portion of a concrete bed formed in accordance with the present invention.

In the present invention of a method and apparatus, the transverse grooves 18, as shown in FIG. 2, have a triangular cross sectional shape. These formational shapes minimize the volume of water which may accumulate in the bottoms of the grooves and provide expansion space for freezing water in the event residual water remains in the grooves.

Figure 3:
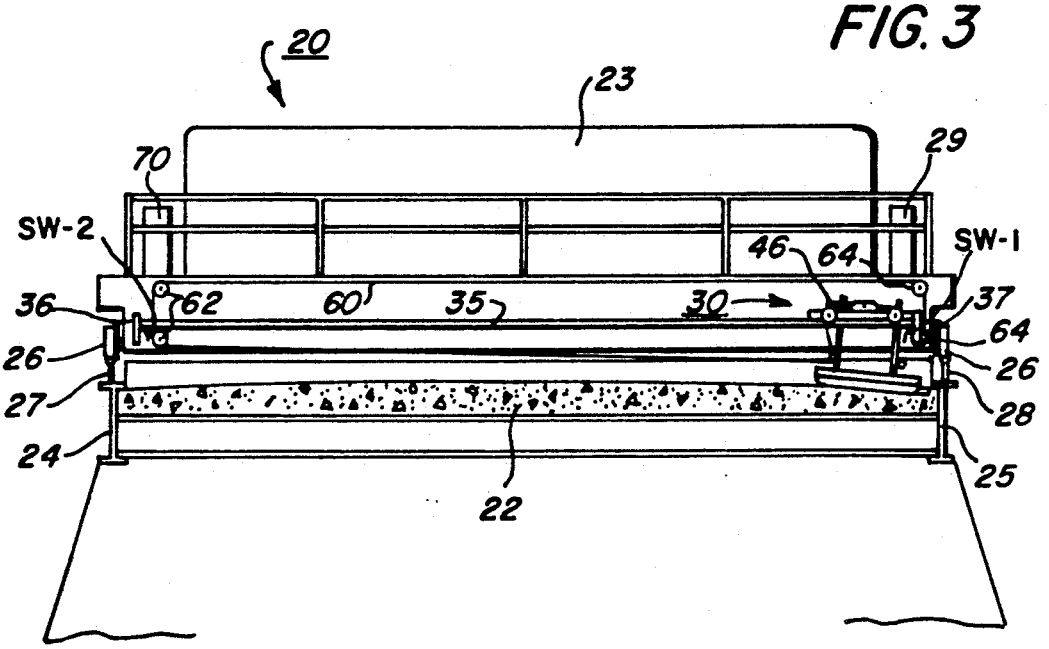
FIG. 3 is a schematic view of a paving machine utilized in the present invention shown in operating position.

In FIG. 3, the apparatus utilized with the present invention, generally indicated at 20, is shown placed transversely across a concrete bed 22 such as a highway bridge deck or airport runway in its unfinished condition during operation of the apparatus. The apparatus, or paving machine 20, includes the conventional concrete laying arrangement having a large hopper or slip form 23 which is adapted to receive repeatedly fresh concrete from trucks and to continuously lay the concrete between side forms comprising the I-beams 24, 25, or other conventional forms to contain the concrete deck mass.

In this operation, the machine 20 includes a plurality of wheels 26 for supporting the same for longitudinal rolling along the bridge during laying of the bed 22. The wheels 26 are supported for this operation upon longitudinally placed, parallel spaced rails 27, 28 supported on the I-beams 24, 25, respectively.

The paving machine 20 is also provided with other devices incidental to the paving of concrete decks such as, for example, a motor drive system 29 generally in the form of a gasoline or diesel engine and a clutch mechanism, for moving the paving machine along the rails 27, 28 during paving operations. Other devices include a scrapper device arranged to form a crowned mass of concrete, vibration means for densifying the mass and a metering apparatus for smoothing the mass to its final dimensions.

In operation of the machine 20, the slip form 23 repeatedly receives deposits of plastic concrete from standby concrete mixing trucks while the machine is slowly moved along the bridge. During this movement, Concrete flows from the lower extrusion device for the machine to begin the formation of the concrete mass for the bed 22 and the other devices incidental to the paving operation are employed to finish the treatment of the concrete. This slip forming operation is made continuous, that is, concrete batches are repeatedly deposited in the paving machine as by a suitable fleet of concrete mixing trucks while the machine continues to pour concrete at the speed suitable for the operation.

In the present invention, this operation is modified to replace the continuous movement of the paving machine with a stop-and-go procedure. The paving machine 20 is moved a predetermined distance and stopped for a time period necessary to accomplish grooving in the surface of the newly laid and finished concrete, whereupon movement is resumed. This movement of the machine a pre-determined distance, stopping and resumption of movement, continues as a stop-and-go operation.

Grooving is achieved by use of a carriage 30 mounted on the frame for the machine 20 for reciprocal movement from side to side thereof transverse to the bed 22. As shown in FIGS. 5 and 6, the carriage includes a rectangular frame 32 having a plurality of wheels 34 on each side thereof rotatably supported on parallel rails 35, mounted on side supports 36, 37 secured to the machine 20 aft thereof. With the carriage 30 located aft of the machine 20, grooving is effected after the concrete is poured by the machine and is in finished condition for eventual curing. The length of the rails 35 may be extended as is necessary for different widths of the bed 22 by suitable extensions. This may be accomplished by varying the distance between the supports 36, 37 on the machine 20. The supports 36, 37 also serve as stops for the movement of the carriage 30 to the limits of its movement.

The carriage 30 serves to support a grooving cutter bar 40 formed with a plurality of elongated cutter blades 42 arranged in close parallel relationship. The cutter bar 40 is supported on and depends from the frame 32 by four corner-oriented rods 44*a*, 44*b*, 44*c*, 44*d*, each of which is suspended from a corner of a rectangular rocker plate 46. As shown in FIG. 5, the rocker plate 46 is pivotally mounted centrally at edges on the frame 32 by means of vertical brackets 48 formed on the frame which support pivot pins 50 formed on the opposite edges of the plate 46.

The rods 44*a*, 44*b*, 44*c*, 44*d* are threaded at their upper ends to receive adjusting nuts 52 which rest upon the upper surface of the rocker plate 46. The rods extend through suitable enlarged openings 54 formed in the frame 32 and are pivotally connected to corresponding corners of the cutter bar 40 by pivot pins 56.

The cutter bar 40 is adapted for limited pivotal movement about the axis defined by the axis of the pivot pins 50. As will be described below, means are provided for driving and rocking the cutter bar, and consequently the blades 42 to positions wherein the leading ends project above and assume the surface of the concrete pad 22 during the grooving operation.

Each of the blades 42 has a tapered forming edge which is adapted to penetrate the surface of plastic concrete in a concrete pad to form the tapered grooves 18, as shown in FIG. 2. The depth of grooving can be determined by the distance each of the tips 58 of the edges extends below the lower surface of the cutter bar 40 when the cutter bar is placed upon and penetrates the surface of the bridge deck. When so placed, and as the cutter bar is driven across the concrete pad 22 during the grooving operation and at a slightly tilted angle so that the lower surface of the bar 40 at the trailing edge defines the lower limit to which the blades 42 will protrude into the plastic concrete.

Operation of the carriage 30 in automatic and continuous reciprocal movement on the apparatus 20 and transversely of the bed 22 is achieved by a control system including the drive mechanism 70, the engine/-clutch mechanism 29, and circuitry devised for controlling various electrical/mechanical components as shown in FIG. 8.

As previously described, the carriage 30 is adapted for reciprocal movement above the concrete bed 22 by means of wheels mounted on the frame 32 of the carriage and parallel rails 35 which support the carriage for this purpose. Reciprocal movement is imparted to the carriage by means of a chain 60 trained around a pair of sprockets 62 mounted at one end of the apparatus 20 and a pair of similar sprockets 64 mounted at the other end.

Figure 4:
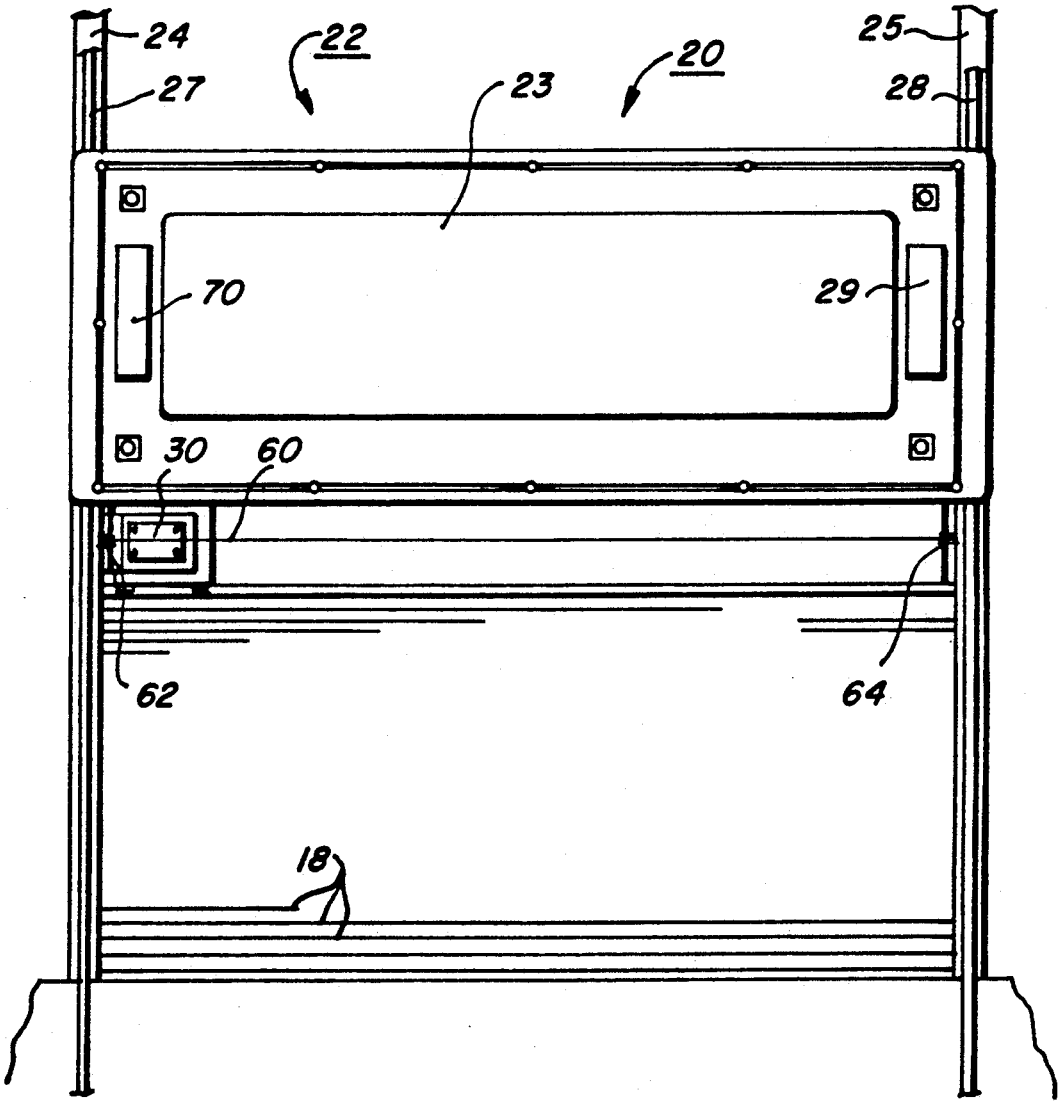
FIG. 4 is a plan view of the machine in FIG. 3.

One end of the chain 60 is anchored at the midpoint of one end of the rocker plate 46, and the other end is anchored at the midpoint of the opposite end of the rocker plate. As shown in FIGS. 4 and 5, one of the lower runs of the chain 60 leading from the sprockets 64 passes below the carriage 30, is trained around a sprocket 65 mounted on and below the frame 32, and is connected at the further end thereof by an anchor 66. The other lower run of the chain leading from the sprockets 62 passes below the carriage, is trained around a sprocket 67 mounted on and below the frame 32, and is connected at the opposite end thereof by an anchor 68.

One of the sprockets 62 is drivingly connected to a drive mechanism 70 preferably in the form of a reversible d.c. motor with gear/clutch mechanisms. As shown in FIG. 5, as the lower run of the chain is driven to the right, as indicated by the solid arrow, the rocker plate 46 is first rocked slightly counter clockwise about the pivots 50 by reason of the anchor connection at 66 being at the opposite end of the carriage 30 from the direction of the pulling force of the chain. This rocking of the plate 46 produces slight upward movement of the rods 44*a*, 44*b* which lifts the leading end of the cutter bar 40 and therefore the leading ends of the blades 42 slightly above the surface of the bed 22. This action causes the rear portions of the blades to become embedded in the concrete of the bed 22.

Continued pulling of the chain in this direction produces movement of the carriage to the right until the same contacts a limit switch SW-1 associated with support 37 which serves as a stop to the continued movement of the carriage. In this movement, the blades 42 cut through the surface of the concrete to produce a set of grooves 18, depending upon the number of blades. In actual practice, the weight of the lower run of the chain 60 when the same is in a slack condition is sufficient to cause the slight rocking rotation of the plate 46 to effect the results described above. Slack for this effect is produced when the carriage reaches the stop 37 and the drive of the sprocket 62 ceases whereby the pulling tension in the chain 60 is released.

Upon contacting the limit switch SW-1 associated with the stop 37, the drive mechanism 70 becomes de-energized through a suitable circuit thereby terminating motion of the carriage. The control system for the apparatus 20 is arranged so that the drive mechanism 70 will become re-energized after a suitable time period to permit forward movement of the apparatus 20, as will be discussed below.

This reactivation will produce the drive rotation of the sprocket 62 in the opposite direction to cause movement of the carriage 30 in the direction indicated by the dashed arrow illustrated in FIG. 5, or to the left as shown in FIG. 3.

Prior to moving to the left, the slack in the chain 60 resulting in the deactivation of the drive mechanism 70 after the carriage 30 contacts the stop 37 produces a rocking clockwise rotation of the plate 46, as viewed in FIG. 5, which action causes the slight upward movement of the rods 44*c*, 44*d*. This action raises what will now be considered the leading edge of the cutter bar 40 which, in turn, raises the now leading ends of the blades 42 above the surface of the concrete bed 22. In addition, the rocking of the rocker plate 46 effects the lowering of the rear portions of the blades into the surface of the concrete bed so that movement of the cutter bar to the left will cause the formation of the grooves 18 in the bed.

In moving to the left, as shown in FIG. 3, the carriage 30, after it traverses the width of the bed 22 to produce another set of grooves 18, contacts a limit switch SW-2 associated with the support 36 which serves as a stop for the leftward movement of the carriage. Upon this occurrence, the drive mechanism 70 is again deactivated to stop the driving force of the chain 60 and to arrest movement of the carriage in the leftward direction. Again, after a slight time delay to allow forward movement of the apparatus 20, the mechanism 70 is reactivated to effect movement of the carriage to the right, as previously described, and the production of another set of grooves 18 in the plastic concrete bed 22.

After the carriage is moved across the bed 22 and contacts one of the stops 36, 37, and before movement is imparted thereto in the opposite direction, the apparatus 20 is driven along the bed by the drive mechanism 29 a distance equal to the spacing between the outermost blades 42 of the cutter bar 40. In this manner, the outermost groove 18 formed by the previous movement of the carriage across the bed 22 will receive the innermost blade 42 as the carriage returns. This arrangement results in grooving of the bed which is accurate as to spacing of the grooves and therefore efficient for the purpose of grooving.

In order to insure accurate groove spacing, the wheels 34 are formed with a peripheral groove 75 and the rails 35 comprise a construction of angle iron having their angled peaks 76 meshing with the grooves 75. With the carriage 30 properly seated on the rails 35, side motion of the carriage due to structural tolerances and imperfections are eliminated so that the aforesaid placement of the innermost blade will always be placed accurately in the outermost previously formed groove.

The control system includes a controller 75, the electrical drive system 70 mounted on the carriage 30, the limit switches SW-1, SW-2 positioned adjacent the carriage stops, respectively, and the drive mechanism 29. The switches SW-1, SW-2 are arranged for contact with the carriage 30 and activation thereof when the carriage reaches the respective stops. As the carriage 30 is driven by the drive mechanism 70 to the left, as viewed in FIG. 3, the cutter bar 40 is dragged on top of and across the surface of the plastic concrete deck 22 by the chain 60 whereby the blades 42 form the grooves 18.

When the carriage reaches one of the switches SW-1, SW-2, the same actuates to open the electrical circuit for the drive mechanism 70 to terminate further movement of the carriage. Upon this occurrence, the clutch mechanism associated with the drive engine 29 for the paving apparatus 20 is activated to initiate movement of the paving machine and effect laying of additional concrete along the bed 22. The distance of this movement of the machine 26 is arranged to correspond with the width of the cutter bar 42 as described above.

After the paving machine 20 is moved the distance corresponding to the width of the cutter bar, the clutch mechanism for the drive 29 is activated to stop movement of the paving machine 20 The drive mechanism for the carriage 30 is again energized to drive the carriage in the reverse direction. This movement of the carriage produces another series of grooves 18 in the plastic concrete of the bed 22. Upon reaching the other side of the machine 20, the carriage 30 will again engage, the other limit switch thereby opening the circuit to the drive mechanism 70 to terminate further movement of the carriage and formation of the grooves 18.

The control system is adapted to continue the aforementioned automatic operation of the machine 20 by sequential operation of the drive mechanisms 29 and 70. In this operation, the cutter bar 40 is reciprocally moved across the plastic concrete of the bed 22 forming side-by-side series of grooves 18 transverse to the longitudinal axis of the bridge deck. By virtue of the cutter bar and the blades 42 being rocked before each grooving operation by an amount which places the leading ends of the blades slightly above the surface of the bed 22 and remaining portions of the blades imbedded in the concrete, the tendency for plowing by each of the blade ends and the leading edge of the cutter bar mainly as a result of these ends striking aggregate in the concrete is eliminated.

While the present invention has been described and illustrated in an arrangement which is fully automatic with the paving of a bridge deck so that transverse grooving is accomplished during the paving operation, the invention may be practiced separately from the paving operation and at a later time. For example, the paving machine 20 may be set in operation in the conventional nonstop manner to function solely for paving the bed 22. At some later time, while the concrete is still plastic, the machine 20 may be brought back to its starting position to repeat the trip along the bridge deck. During this second trip, only the grooving function using the drive mechanism 70, as described above, is utilized.

In still another arrangement of operation, in its simplest form, the carriage 30 may be moved manually in one or both directions to effect grooving. Rather than forming a part of the conventional paving machine 20, the carriage 30 and drive mechanism 70 and other related structures may be incorporated into a separate supporting vehicle arranged to travel along the rails 27, 28.

While the invention has been disclosed with reference to the structure disclosed, it is not confined to the details set forth but is intended to cover such modifications or changes as may come within the scope of the following claims.

What is claimed is:

1. A method for forming transverse grooves in a concrete bed such as a bridge deck or an airport runway comprising the steps of:

depositing concrete on the bed and thereby present a concrete mass in the plastic condition thereon, impressing a plurality of parallel arranged cutter blades each having a tapered cutting edge into the surface of the plastic concrete, tilting said cutter blades relative to the surface of the concrete sufficiently to position the leading edges of the blades above the surface and the trailing edges below the surface, and moving said cutter blades with the tapered edges imbedded into the surface of the plastic concrete in a direction normal to the longitudinal axis of the concrete bed thereby producing a series of parallel tapered transverse grooves therein.

2. The method of claim 1 wherein the step of moving said cutter blades is a reciprocal movement from one side of the concrete area to the other.

3. A method for forming transverse grooves in a concrete bed such as a bridge deck or an airport runway comprising the steps of:

depositing concrete on the bed and thereby present a concrete mass in the plastic condition thereon, impressing a plurality of parallel arranged cutter blades each having a tapered cutting edge into the surface of the plastic concrete, tilting said cutter blades relative to the surface of the concrete bed sufficiently to position the leading edges of the blades above the surface and the trailing edges below the surface, moving said cutter blades with the tapered edges imbedded into the surface of the plastic concrete from one side of the bed in a direction normal to the longitudinal axis of the bed to the other side of the bed thereby producing a first series of parallel tapered transverse grooves across the concrete bed, transporting said cutter blades a predetermined distance in a direction parallel to said longitudinal axis of the bed, and moving said cutter blades imbedded into the plastic concrete from said other side of the bed back to said one side of the bed thereby producing a second series of tapered transverse grooves across the concrete bed.

* * * * *